United States Patent [19]

Gibree

[11] Patent Number: 4,761,009

[45] Date of Patent: Aug. 2, 1988

[54] GOLF PUTTING GAME DEVICE

[76] Inventor: Paul Gibree, 69 Upsala St., Worchester, Mass. 01607

[21] Appl. No.: 18,522

[22] Filed: Feb. 25, 1987

[51] Int. Cl.[4] ..... A63B 69/36

[52] U.S. Cl. ..... 273/177 R; 273/185 R

[58] Field of Search ..... 273/179 R, 179 A, 179 B, 273/179 C, 179 D, 179 E, 180, 184 A, 185 R, 176 F, 176 FA, 176 FB, 176 B, 127 R, 127 C

[56] References Cited

U.S. PATENT DOCUMENTS

| | | | |
|---|---|---|---|
| 1,799,263 | 4/1931 | Swain et al. | 273/179 B |
| 1,911,402 | 5/1933 | Scurlock | 273/180 |
| 2,379,663 | 7/1945 | Smith | 273/179 C |
| 3,575,559 | 4/1971 | Tierney | 273/184 A |
| 3,817,535 | 6/1974 | Doughty | 273/180 |
| 4,120,496 | 10/1978 | Niina | 273/184 A |
| 4,327,917 | 5/1982 | Bagley | 273/179 A |

*Primary Examiner*—George J. Marlo

*Attorney, Agent, or Firm*—Leon Gilden

[57] ABSTRACT

A golf ball game wherein a housing is provided with slots for receiving a golf ball therethrough. A ball return floor panel rearward of the slots communicates with a ball receiving floor panel positioned forwardly of the slots. The ball receiving panel includes a first lane section which is upwardly inclined so as to slow a putted ball entering the ball receiving panel, and a second lane section which is downwardly sloped so as to allow the putted ball to actuate a signal device for indicating which of said slots is entered by a putted ball. The signal device includes a plurality of lights wherein a single light is in overlying position to each of the plurality of slots and the plurality of lights are of various colors to indicate different levels of accuracy. A movable plate is associated with each slot for sensing the weight of a golf ball to actuate a microswitch and the single light associated therewith.

1 Claim, 2 Drawing Sheets

GOLF PUTTING GAME DEVICE

BACKGROUND OF THE INVENTION

1. Field of the Invention

The present invention relates to golf practice devices, and more particularly pertains to a new and improved golf putting game device which utilizes signaling lights for indicating the accuracy of a put.

2. Description of the Prior Art

The use of various golf putting game devices which provide an indication of accuracy through the use of indicating lights is well known in the prior art. For example, U.S. Pat. No. 3,011,791, which issued to C. Page on Dec. 5, 1961, discloses a golf putting game device which has a centrally disposed hole into which the ball should be putted with a plurality of circumferentially extending troughs being designed to receive a ball which misses the hole. Electric switches provided in the troughs illuminate a scoring mechanism, while other lights indicate the number of balls utilized during the playing of the game.

Another prior art reference of interest is U.S. Pat. No. 3,588,117, which issued to I. Hertenstein on June 28, 1971. The Hertenstein device comprises a putting lane which includes a simulated grass carpet with cups having different scoring values adapted to receive a golf ball putted along the lane. Electric lights or signals for each cup are provided, as is a return for a ball received in the cups. The energizing mechanism takes the form of an unbalanced trough swingably mounted below each cup and including an electrical switch, such as a mercury switch, which is actuated when a ball drops through the cup onto the trough and tilts the same downwardly. While being functioning for its intended purpose, the Hertenstein device is substantially complex in design and as such is difficult to manufacture. Of course, the above described golf putting game device by the inventor Page is even more complex in design and possesses a much higher degree of manufacturing complexity.

As such, there would appear to be a continuing need for new and improved golf putting game devices which are simple in design and which could be easily and inexpensively manufactured, while functioning perhaps in the manner of the Hertenstein device, and in this respect, the present invention addresses this need.

SUMMARY OF THE INVENTION

In view of the foregoing disadvantages inherent in the known types of golf putting game devices now present in the prior art, the present invention provides an improved golf putting game device wherein a plurality of signal lights may be actuated to indicate the accuracy of a putted ball directed into the device, while a sloped trough then functions as a ball return, thereby substantially eliminating the complexities of design and construction now present in the prior art. As such, the general purpose of the present invention, which will be described subsequently in greater detail, is to provide a new and improved golf putting game device which has all the advantages of the prior art golf putting game devices and none of the disadvantages.

To attain this, the present invention comprises a ball receiving device which includes a first upwardly and then downwardly sloped ball receiving lane with the intent of the game being to position the ball in a centrally disposed portion of the lane. A plurality of lights are positioned across the lane in a housing constructed thereabove, and contact switches at the bottom back of the device, when struck by a putted ball, activate the associated light. In this regard, when a ball is directed to the left of the center position on a lane, an appropriately positioned light will be activated and if desired, a certain score can be assigned to that light. A trough extending along a back portion of the lane then receives the ball and directs the same downwardly along a sloped portion thereof, whereby the ball is then expelled from the device and directed back to the player.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved golf putting game device which has all the advantages of the prior art golf putting game devices and none of the disadvantages.

It is another object of the present invention to provide a new and improved golf putting game device which may be easily and efficiently manufactured and marketed.

It is a further object of the present invention to provide a new and improved golf putting game device which is of a durable and reliable construction.

An even further object of the present invention is to provide a new and improved golf putting game device which is susceptible of a low cost of manufacture with regard to both materials and labor, and which accordingly is then susceptible of low prices of sale to the consuming public, thereby making such golf putting game devices economically available to the buying public.

Still yet another object of the present invention is to provide a new and improved golf putting game device which provides in the apparatuses and methods of the prior art some of the advantages thereof, while simultaneously overcoming some of the disadvantages normally associated therewith.

Still another object of the present invention is to provide a new and improved golf putting game device which provides for a much simpler means of scoring the accuracy of a putted ball.

Yet another object of the present invention is to provide a new and improved golf putting game device which allows a golfer to practice putting in various chosen locations.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
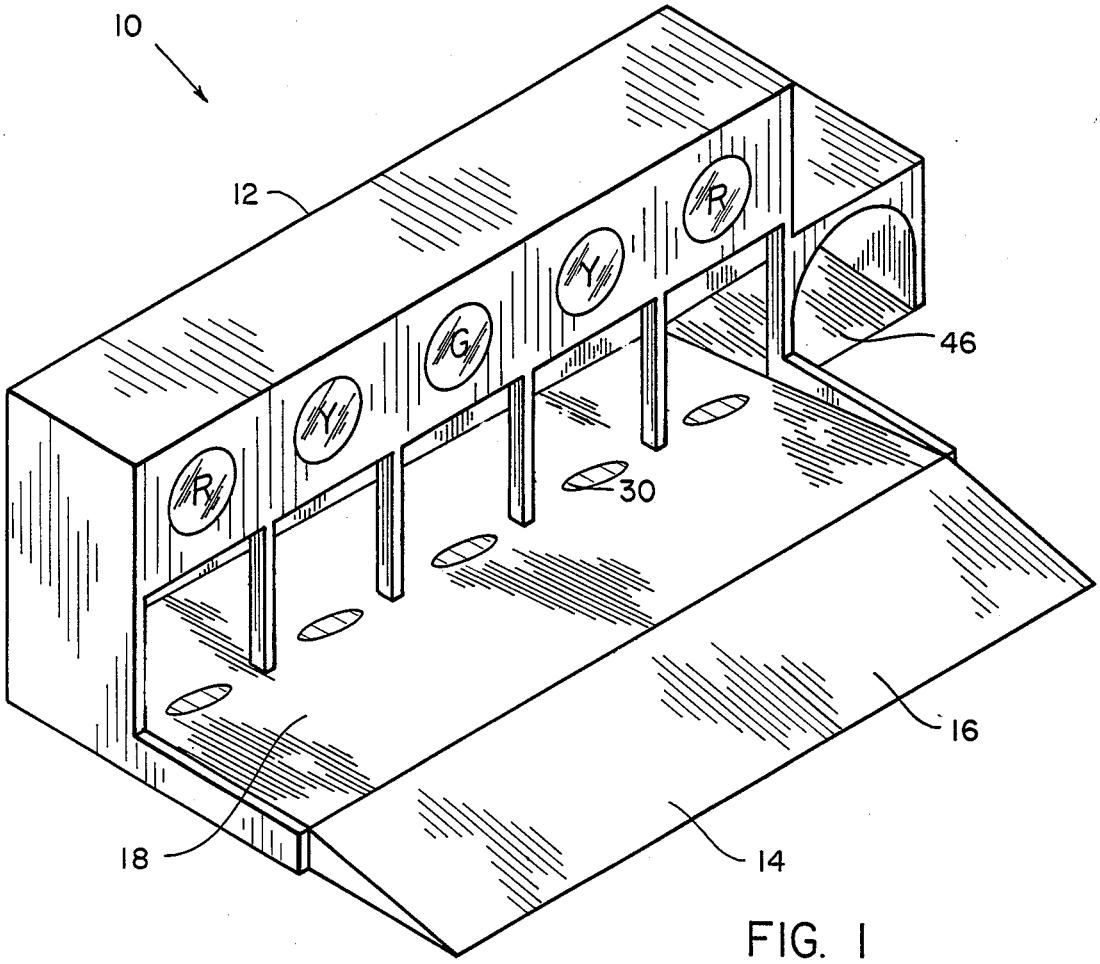
FIG. 1 is a perspective view of the golf putting game device comprising the present invention.

With reference now to the drawings, and in particular to FIGS. 1–4 thereof, a new and improved golf putting game device embodying the principles and concepts of the present invention and generally designed by the reference numeral 10 will be described.

Figure 2:
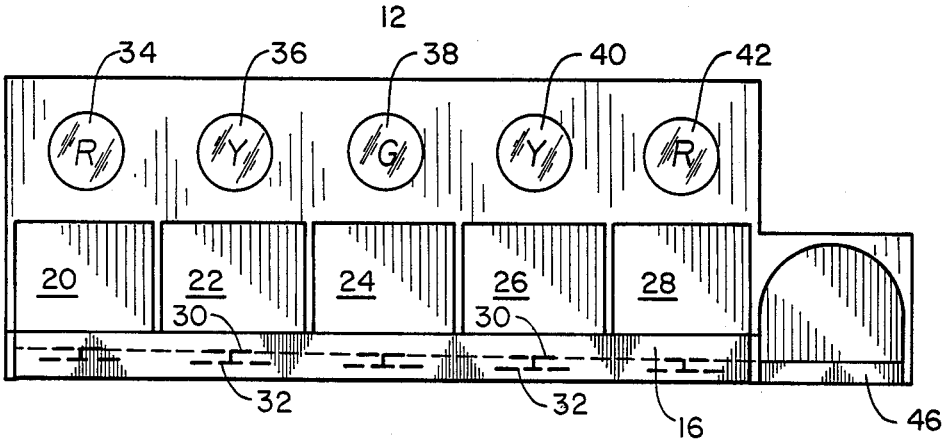
FIG. 2 is a front elevation view of the invention.
Figure 3:
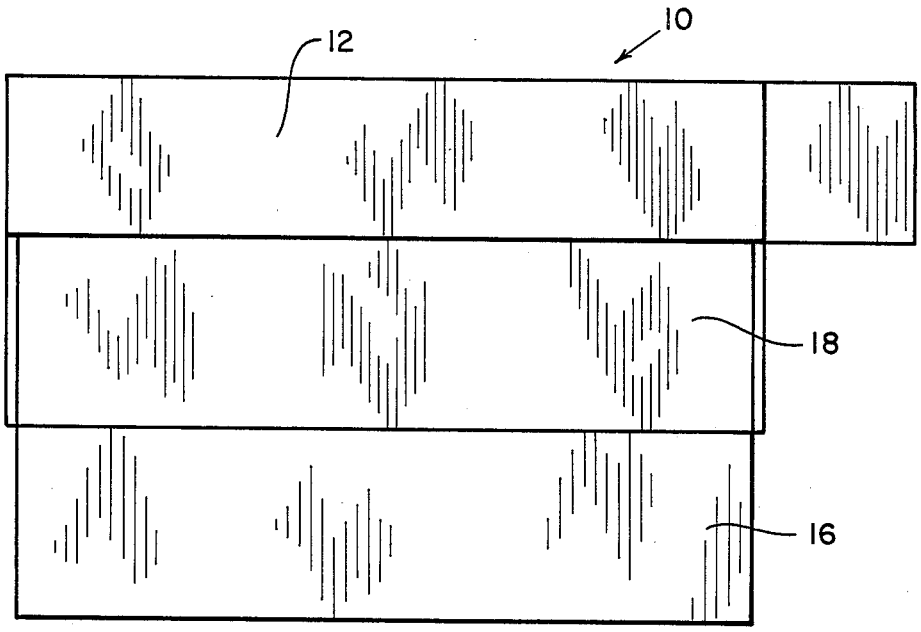
FIG. 3 is a top plan view of the invention.
Figure 4:
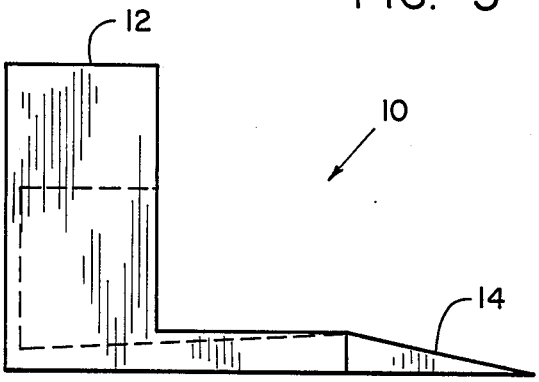
FIG. 4 is a left side elevation view thereof.
Figure 5:
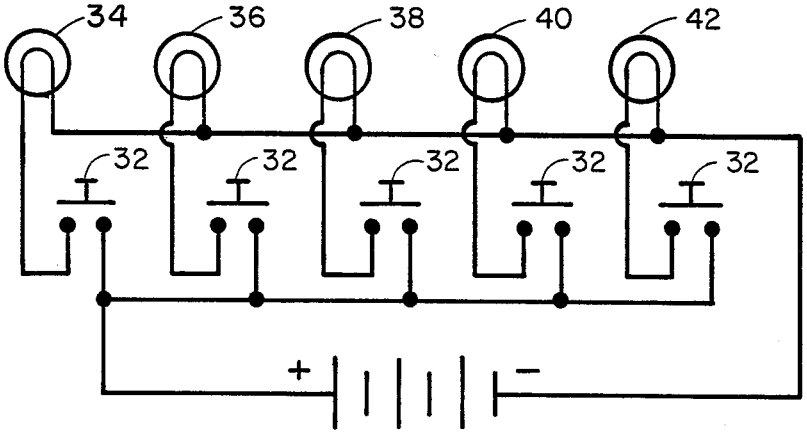

More specifically, it will be noted that the golf putting game device 10 essentially comprises a housing 12 that includes a ball receiving land 14. The lane 14 includes an upwardly sloped portion 16 followed by a downwardly sloped portion 18 which facilitates the rolling of a putted ball into a rear portion of the housing. As best illustrated in FIG. 2, a plurality of slots 20, 22, 24,, 26, 28 serve to guidingly receive a putted ball, with the floor portion of each of these slots including similar plate members 30 movably positioned thereon. The plate members 30 are positioned over a plurality of microswitches 32, with such microswitches being operable in response to the sensed weight of a ball passing over a particular plate. In this regard, microswitches 32 operate in a conventional manner to switch on and off a plurality of differently colored lights 34, 36, 38, 40, 42 each of which is respectively positioned over one of the slots 20, 22, 24, 26, 28.

Rearwardly of each of the slots 20, 22, 24, 26, 28 is a trough forming a part of the downwardly sloped lane surface 18, with this trough being sloped to the right of the housing 12, thereby to allow a golf ball to roll downwardly and outwardly through a guide channel 44. The channel 44 drops a ball onto a further downwardly sloped lane 46 so that the ball is returned to the game player.

As to the manner of usage and operation of the present invention, the same should be apparent form the above description. However, a brief summary thereof will be provided. More specifically, it can be appreciated that the player of the game will stand forwardly of the housing 12 so as to face the ball receiving lane 14. The ball should be putted towards the housing 12 with the intent being to drive the same into the slot 24. Provided that the ball enters the slot 24, the microswitch 32 associated with the plate member 30 in the bottom of the slot will turn on the light 38, thus to indicate a good putt. If desired, a score can be awarded for activating the light 38. Additionally, a timing mechanism may be provided in electrical communication with the microswitch 32 to effect a deactivation of the light after a preselected time period. If the player misses the slot 24 and instead directes a ball into one of the other slots 20, 22, and 26, 28, the respective lights 34, 36, 40, 42 associated therewith will be activated thus to indicate a less accurate putt. In the preferred embodiment of the invention, it is envisioned that the light 38 would be of a green color and would award one point when a ball is directed through the slot 24. Similarly, the lights 36, 40 could be of a yellow color and a player would be awarded two points for sending a ball into one of these slots. The outermost slots 20, 28 would have red lights 34, 42 positioned thereabove with three points being awarded for balls directed into these slots. Of course, the intention of the game would be to obtain as low a score as possible.

With respect to the above descripion then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A golf putting game comprising:

a housing and ball receiving slot means formed in said housing for receiving golf balls therethrough wherein said slot means includes a plurality of slots where a putted golf ball may enter only one of said slots during putting, a ball return trough positioned rearwardly of said slots for returning golf balls from said housing, a ball receiving lane means positioned forwardly of said slot means for initially receiving a putted ball, said ball receiving lane means including a first lane section which is upwardly sloped so as to slow said putted ball entering said lane means and a second lane section which is downwardly sloped so as to allow said putted ball to actuate signal means for indicating where said putted ball enters said slot means wherein said signal means includes a plurality of lights wherein a single light is in overlying position to each of said plurality of slots and said plurality of lights are of various colors to indicate different levels of accuracy, and a microswitch associated with each of said plurality of slots for actuation of said single lights associated therewith, said microswitches being associated with moveable floor plates mounted on said second lane section and within said slots, said plates being moveable in response to the sensed weight of a golf ball passing thereover to activate said microswitches.

* * * * *